US005119282A

United States Patent [19]

Meyer et al.

[11] Patent Number: 5,119,282

[45] Date of Patent: Jun. 2, 1992

[54] REFLECTOR LAMP ASSEMBLY UTILIZING LENS THAT SNAPS INTO REFLECTOR

[75] Inventors: Kevin L. Meyer; Mark D. Beschle, both of Beverly, Mass.

[73] Assignee: GTE Products Corporation, Danvers, Mass.

[21] Appl. No.: 630,403

[22] Filed: Dec. 19, 1990

Related U.S. Application Data

[63] Continuation of Ser. No. 388,272, Aug. 1, 1989, abandoned.

[51] Int. Cl.[5] ..... F21V 7/00

[52] U.S. Cl. ..... 362/306; 362/308; 362/267; 362/455

[58] Field of Search ..... 362/61, 80, 267, 308, 362/310, 328, 329, 374, 375, 457, 455, 306, 226

[56] References Cited

U.S. PATENT DOCUMENTS

| | | | |
|---|---|---|---|
| 3,539,799 | 11/1970 | Danganthier | 362/328 |
| 3,745,677 | 7/1973 | Moran | 362/320 |
| 3,780,282 | 12/1973 | Riley et al. | 362/267 |
| 4,276,585 | 6/1981 | Deverrewaere | 362/329 |
| 4,574,338 | 3/1986 | Takasaki et al. | 362/61 |
| 4,930,050 | 5/1990 | Poizner | 362/267 |
| 4,998,190 | 3/1991 | Claessen | 362/457 |

*Primary Examiner*—Ira S. Lazarus
*Assistant Examiner*—D. M. Cox
*Attorney, Agent, or Firm*—Joseph S. Romanow

[57] ABSTRACT

A lamp assembly includes a lamp capsule, a reflector, an electrical connector and a lens. The lamp capsule includes a lamp envelope having a base portion, and the reflector includes an opening for receiving the base portion of the lamp envelope. The reflector is fabricated of a resilient material such as a high temperature thermoplastic or thermosetting plastic. The base portion of the lamp capsule and the reflector include lamp interlocking elements which mechanically lock the lamp capsule in the reflector. The lamp interlocking elements preferably position the center of light output of the lamp capsule at the focal point of the reflector. The connector and a neck portion of the reflector include connector interlocking elements which mechanically lock the connector to the reflector. The lens and the outer rim of the reflector include integral lens interconnecting elements which mechanically lock and position the lens on the reflector.

4 Claims, 3 Drawing Sheets

REFLECTOR LAMP ASSEMBLY UTILIZING LENS THAT SNAPS INTO REFLECTOR

This is a continuation of copending U.S. application Ser. No. 07/388,272 filed on Aug. 1, 1989 now abandoned.

CROSS REFERENCE TO RELATED APPLICATIONS

This application discloses, but does not claim subject matter which is claimed in U.S. Pat. Nos. (4,982,131) and (4,982,132) filed concurrently herewith and assigned to the assignee of this application.

FIELD OF THE INVENTION

This invention relates to electric lamp assemblies having reflectors and, more particularly, to reflector lamp assemblies utilizing one or more plastic snap-together components to facilitate assembly.

BACKGROUND OF THE INVENTION

Reflector lamp assemblies are widely used for both indoor and outdoor lighting. Such assemblies include a lamp capsule, which may be a tungsten incandescent lamp, a tungsten halogen lamp or a high intensity discharge lamp, mounted at the center of a reflector. The reflector is typically parabolic in shape, and the front of the reflector is covered with a lens. Electrical energy is provided to the lamp capsule through a connector mounted on the rear of the reflector. The reflector is typically made of glass having a reflective coating on its inner surface. Light from the lamp capsule is directed in a preferred direction by the reflector.

While prior art reflector lamp assemblies have provided satisfactory performance, assembly techniques have been relatively complex and expensive. Current processes for securing a lamp capsule into a reflector involve either welding the capsule electrical leads to heavier leads which are soldered to ferrules at the base of the reflector, or cementing the press seal of the lamp capsule into the throat of the reflector. Both of these processes involve several precise, expensive and often labor intensive operations. Processing time is greatly extended due to cement curing requirements. Both welding and cement can damage the reflector surface.

One important requirement is that the center of light output from the lamp capsule must coincide with the focal point of the reflector. Deviations from this requirement degrade the light output pattern. Alignment of the lamp capsule so that the filament is in the optimum optical location in the reflector currently involves difficult manufacturing processes. In one process, the light capsule is energized and is moved within the reflector until the optimum location is found. Then, cement is applied. This is a slow and labor intensive process.

Current processes for attaching the electrical connector to the reflector assembly involve cementing, welding or peening. All of these processes have manufacturing and cost disadvantages. Cementing causes severe maintenance problems and prolongs production cycle time due to curing requirements. Welding can damage both the appearance and the mechanical properties of the connector and the reflector. Peening can lead to broken lamps and loose connectors.

Current processes for attaching a lens to a reflector include application of cement or epoxy, flame sealing and ringing. As noted above, cement and epoxy cause severe maintenance problems and prolong production cycle time due to curing requirements. Flame sealing is an expensive and complicated process and can result in thermal stress failures. Ringing, which involves the use of a clamp-like ring for securing the lens to the reflector, does not securely fasten the lens to the reflector. As a result, there is a likelihood that the lamp will chatter through its life.

The above-described assembly techniques result in permanent attachments between the lamp capsule, reflector, lens and connector. Prior art lamp assemblies have also utilized a variety of connector arrangements for mechanical mounting and electrical connection of lamp capsules. Typical assemblies are disclosed in U.S. Pat. Nos. 3,885,149, issued May 20, 1975 to Wolfe et al, 4,569,006, issued Feb. 4, 1986 to Bergin et al, 4,719,543, issued Jan. 12, 1988 to Coliandris et al, 4,752,710, issued Jun. 21, 1988 to Devir et al and 4,724,353, issued Feb. 9, 1988 to Devir. All known prior art lamp assemblies involve a lamp base comprising one or more metal or plastic parts affixed to the base portion of the lamp capsule. The base is mounted in a socket. Such assemblies are relatively expensive to manufacture, since they involve multiple separate parts that must be assembled together.

It is a general object of the present invention to provide improved reflector lamp assemblies.

It is another object of the present invention to provide reflector lamp assemblies which are easy to manufacture and are low in cost.

It is a further object of the present invention to provide a reflector lamp assembly wherein a lens snaps directly into a resilient reflector.

SUMMARY OF THE INVENTION

According to the present invention, these and other objects and advantages are achieved in a lamp assembly comprising a reflector including a front, a rear and an outer rim, the reflector being fabricated of a high temperature, resilient thermoplastic or thermosetting plastic, a lamp capsule mounted on the front of the reflector, means for connection of the lamp capsule to a source of electrical energy, and a lens secured to the outer rim of the reflector. The lens and the outer rim of the reflector include integral lens interlocking elements which mechanically lock and position the lens on the reflector.

In a preferred embodiment, the interlocking elements include a groove near the outer rim of the reflector for receiving the peripheral edge of the lens.

BRIEF DESCRIPTION OF THE DRAWINGS

For a better understanding of the present invention together with other and further objects, advantages and capabilities thereof, reference is made to the accompanying drawings which are incorporated herein by reference and in which.

DETAILED DESCRIPTION OF THE INVENTION

Figure 1:
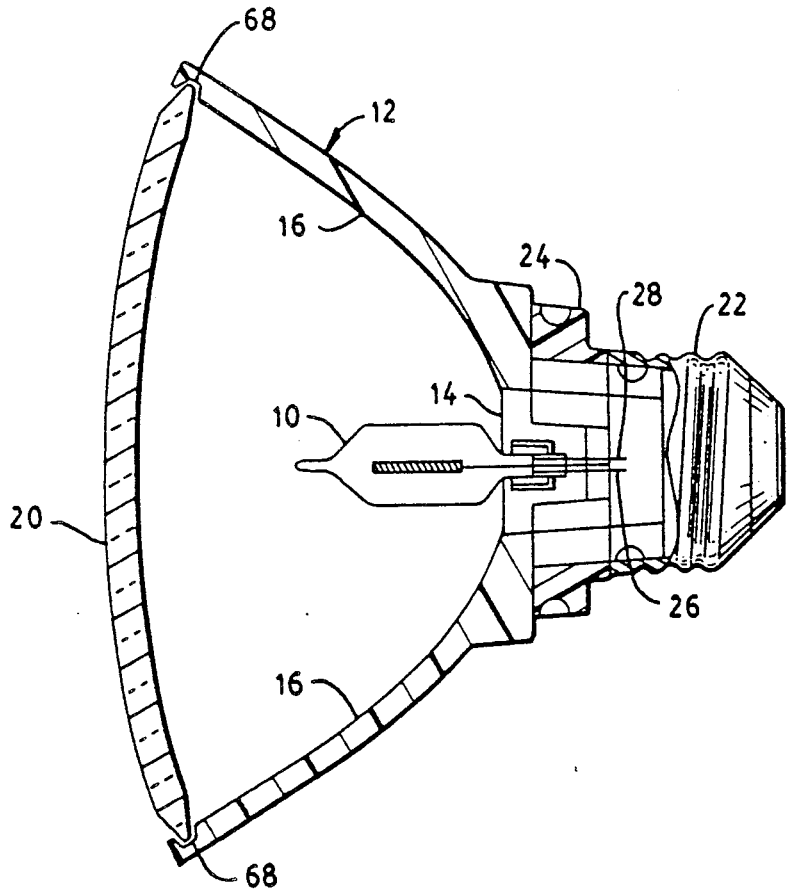
FIG. 1 is a cross-sectional view of a reflector lamp assembly in accordance with the present invention.

A reflector lamp assembly in accordance with the present invention is shown in FIG. 1. A lamp capsule 10 is mounted in a reflector 12. The reflector 12 includes a central throat portion 14 and a reflecting surface 16. The lamp capsule 10 is mounted in throat portion 14. The reflecting surface 16 may, for example, have a parabolic shape. A lens 20 covers an open end, or mouth, of reflector 12. An electrical connector 22 is secured to a neck portion 24 extending from the rear of reflector 12. Electrical leads 26 and 28 of lamp capsule 10 extend through the neck portion 24 and are electrically connected to connector 22. In use, the connector 22 is mounted in a lamp socket (not shown) for electrical connection of the lamp capsule 10 to a source of electrical energy. The reflecting surface 16 directs light from lamp capsule 10 through lens 20 in a preferred direction. By appropriate shaping of reflecting surface 16, the light can be focused or spread out.

Figure 2A:
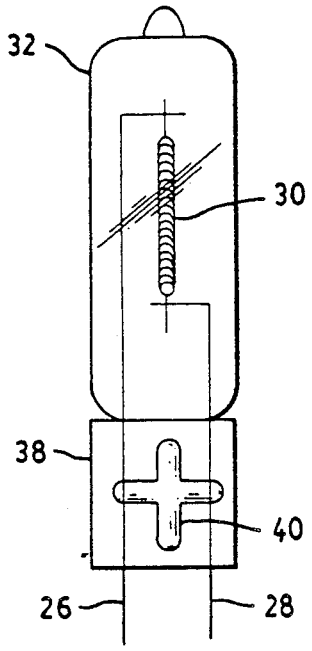
FIGS. 2A and 2B illustrate a lamp capsule having integrally-formed projections in accordance with the present invention.
Figure 2B:
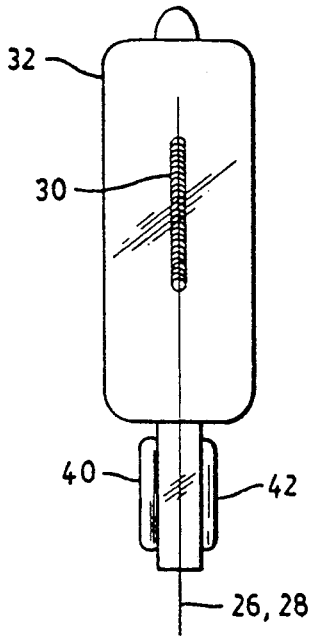

The lamp capsule 10, as best shown in FIGS. 2A and 2B, typically includes a tungsten filament 30 sealed into a lamp envelope 32 of hard glass or quartz. Electrical leads 26 and 28 extend through a press seal 38 and are electrically connected to filament 30. The lamp capsule 10 can be a tungsten incandescent lamp, a tungsten halogen lamp, or a high intensity discharge lamp. The present invention does not require that a particular type of lamp capsule be utilized. By way of example, a typical lamp capsule utilized in the reflector assembly is a tungsten halogen lamp having a power rating in the range of 0.5 watt to 1000 watts.

The press seal 38 is a portion of lamp envelope 32 which has been heated and flattened to hermetically seal leads 26 and 28 into the lamp capsule. The press seal 38 is provided with integrally-formed, raised projections 40 and 42. In the example of FIGS. 2A and 2B, each of the projections 40 and 42 is cross-shaped and is formed of intersecting segments. As described hereinafter, the projections 40 and 42 interlock with corresponding recesses in the reflector 12. The cross-shaped projections 40, 42 are advantageous in limiting movement of the lamp capsule relative to the reflector in two directions. However, other projection shapes can be utilized. Examples include a projection shaped as a single line segment and a pair of spaced-apart projections.

Figure 3A:
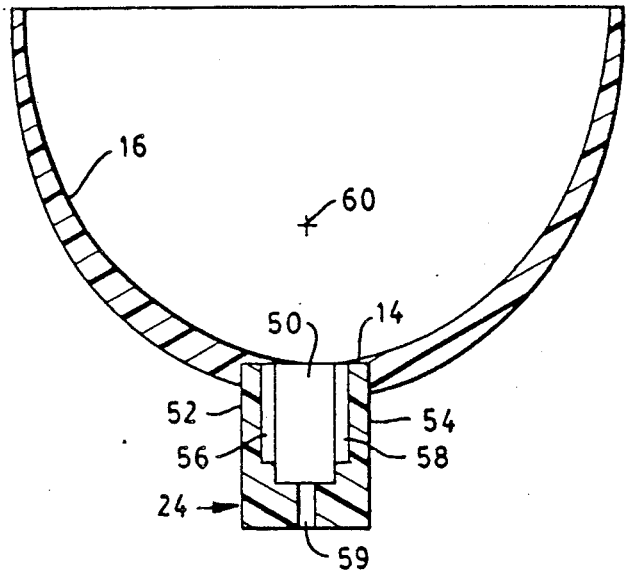
FIG. 3A is a simplified cross-sectional view of a plastic reflector in accordance with the invention.

A cross-sectional view of the reflector 12 with the lamp capsule removed is shown in FIG. 3A. The throat portion 14 of the reflector 12 includes an opening 50 that is sized and shaped to receive the press seal 38. Opening 50 is defined by walls 52 and 54. The neck portion 24 is provided with openings 59 for leads 26 and 28 of lamp capsule 10. Walls 52 and 54 are provided on their inside surfaces with recesses 56 and 58, respectively. Recesses 56 and 58 are sized and shaped to interlock with projections 40 and 42, respectively, on lamp capsule 10. When projections 40 and 42 are cross-shaped, as shown in FIG. 2A, the recesses 56 and 58 are cross-shaped. While the interlocking elements have been shown and described as projections on the lamp capsule and recesses in the reflector, it will be understood that the invention encompasses other configurations such as recesses on the lamp capsule and projections on the reflector, and interlocking projections on both components.

Figure 3B:
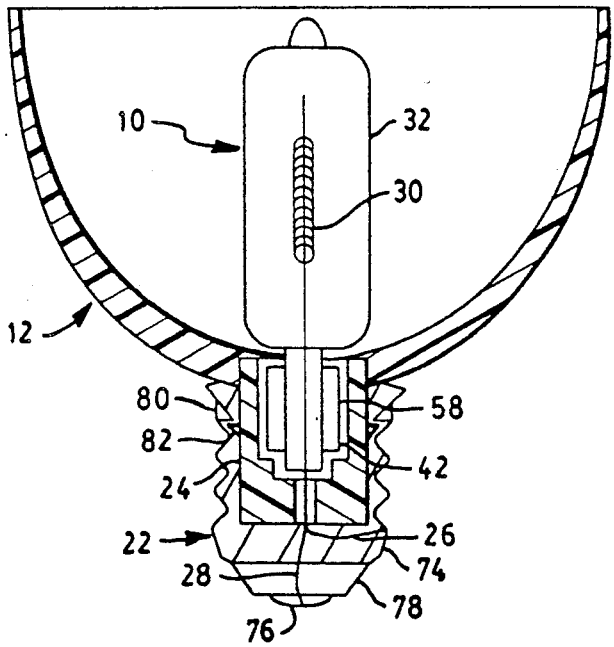
FIG. 3B is a simplified cross-sectional view of a plastic reflector, a lamp capsule and an electrical connector.

The projections 40 and 42 interlock with the recesses 56 and 58 to lock and position the lamp capsule 10 in the reflector 12. The reflector 12 is fabricated, at least in the portion surrounding opening 50, with a resilient material. When the lamp capsule 10 is inserted into opening 50, walls 52 and 54 are deformed slightly until projections 40 and 42 engage recesses 56 and 58. The walls 52 and 54 then return to their original shapes and retain the lamp capsule 10 in position. Thus, the lamp capsule 10 snaps into position in reflector 12 and is securely held in a fixed position without requiring additional elements attached to the base of the lamp capsule. The reflector 12 is illustrated in FIG. 3B with the lamp capsule 10 snapped into position in opening 50. Leads 26 and 28 of lamp capsule 10 extend through openings 59 for electrical connection to connector 22 as described hereinafter.

The reflector 12 is preferably fabricated from a high temperature thermoplastic such Ultem available from General Electric, Ryton available from Phillips Petroleum or Xydar available from Dart Company. High temperature thermosetting plastics can also be utilized. These plastics can be molded with precise dimensional control, are resilient and can withstand the normal operating temperatures of lamps. The reflector 12 is typically required to withstand operating temperatures of 300° C. Elevated temperatures are not required during assembly, since the components of the lamp assembly simply snap together. The reflecting surface 16 can be a coating of aluminum on the plastic surface.

The reflector 12 has a focal point 60. The reflector 12 produces an optimally focused light beam from a point source of light located at focal point 60. The lamp capsule 10, of course, is not an ideal point source. However, the center of light output from light capsule 10 should coincide with focal point 60 for best performance of the reflector lamp assembly. The interlocking projections 40, 42 and recesses 56, 58 permit the lamp capsule 10 to be precisely located relative to focal point 60. Positioning is accomplished by making the distance between the center of light output of lamp capsule 10 and projections 40, 42 equal to the distance between focal point 60 and recesses 56, 58. When the lamp capsule 10 is snapped into reflector 12, it is automatically positioned with the center of light output at focal point 60.

According to another aspect of the present invention, the lens 20 snaps into the open end of reflector 12. The reflector 12 is provided on an inside surface near the outer rim thereof with an annular groove 68. Groove 68 is sized and shaped to engage the peripheral edge of lens 20. Since the reflector 12 is fabricated of a resilient material, its outer edge can be deformed to permit lens 20 to be snapped into place. The lens 20 can be glass or a resilient material such as plastic.

Figure 4:
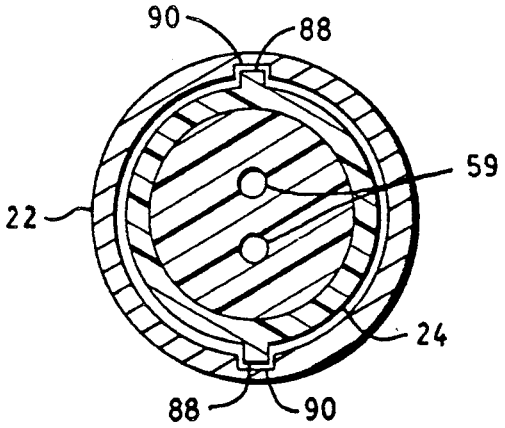
FIG. 4 is a cross-sectional view of the connector and the neck portion of the plastic reflector.

A detail of the connector portion of the reflector lamp assembly is shown in FIG. 3B. Lamp capsule 10 is locked into opening 50 in reflector 12 as described hereinabove. Connector 22 is secured to the neck portion 24 of reflector 12. Preferably, a snap arrangement is utilized for locking connector 22 to neck portion 24. The connector 22 includes an outer conductor 74 and a center conductor 76 separated by an insulator 78. The connector 22 is provided with tabs 80 which engage projections 82 on neck portion 24 of reflector 12. When the connector 22 and the neck portion 24 of reflector 12 are pushed together, the tabs 80 interlock with projections 82 and lock the elements together. The projections 82, the tabs 80, or both, are resilient to provide snap-fit interlocking of connector 22 and reflector 12. As shown in FIG. 4, the neck portion 24 of reflector 12 can be provided with projections 88 which engage recesses 90 in connector 22 to prevent relative rotation between connector 22 and neck portion 24. Leads 26 and 28 are electrically connected to conductors 74 and 76, respectively, typically by welding.

In a preferred embodiment, the components of the reflector lamp assembly, including the lamp capsule, the lens and the connector snap together as described above. However, it will be understood by those skilled in the art that the snap-in components described hereinabove can be utilized separately to provide reductions in assembly costs. The lamp capsule is accurately mounted directly in the reflector without requiring assembly fixtures, additional lamp base components or cement. Similarly, the reflector snaps into the connector, and the lens snaps into the reflector without requiring assembly fixtures, additional components or cement.

While there have been shown and described what are at present considered the preferred embodiments of the present invention, it will be obvious to those skilled in the art that various changes and modifications may be made therein without departing from the scope of the invention as defined by the appended claims.

What is claimed is:

1. A reflector lamp assembly comprising:

a reflector including a front, a rear, and an outer rim, said reflector being fabricated of a high temperature, resilient thermoplastic or thermosetting plastic and being deformable near said outer rim, said reflector having an interior surface and a groove embedded in said interior surface, said groove being substantially parallel to said outer rim and extending continuously and circumferentially around said interior surface of said reflector near said outer rim;

a lamp capsule mounted on the front of said reflector;

means for connection of said lamp capsule to a source of electrical energy; and a lens having an outer edge extending peripherally around said lens without protrusions thereon, said outer edge of said lens being snapped into said groove of said reflector such that said lens is securely mounted on said reflector without an adhesive.

2. A reflector lamp assembly as described in claim 1 wherein said lens is shaped substantially as a portion of the surface of a sphere.

3. A reflector lamp assembly as described in claim 1 wherein said lens is formed from glass.

4. A reflector lamp assembly as described in claim 1 wherein said lens is formed from a substantially rigid material.

* * * * *